US005368655A

United States Patent [19]

Klos

[11] Patent Number: 5,368,655

[45] Date of Patent: Nov. 29, 1994

[54] PROCESS FOR CHROMATING SURFACES OF ZINC, CADMIUM AND ALLOYS THEREOF

[75] Inventor: Klaus P. Klos, Trebur, Germany

[73] Assignees: Alchem Corp., Medina, Ohio; Frederick Gumm Chemical Co., Inc., Kearny, N.J.

[21] Appl. No.: 965,342

[22] Filed: Oct. 23, 1992

[51] Int. Cl.[5] ..... C23C 22/26

[52] U.S. Cl. ..... 148/250; 148/267; 148/252

[58] Field of Search ..... 148/250, 267, 252

[56] References Cited

U.S. PATENT DOCUMENTS

| | | | |
|---|---|---|---|
| 2,559,812 | 7/1951 | Watson | 148/267 |
| 2,819,193 | 1/1958 | Rausch | 148/252 |
| 3,279,958 | 10/1966 | Maurer | 148/252 |

*Primary Examiner*—Sam Silverberg
*Attorney, Agent, or Firm*—Louis E. Marn

[57] ABSTRACT

There is described a process for chromating an article formed of a metal selected from the group consisting of zinc, cadmium and alloys thereof, which includes immersing the article in a water solution of a soluble chromic oxalate complex at a pH of from 1.2 to 3.0.

12 Claims, No Drawings

PROCESS FOR CHROMATING SURFACES OF ZINC, CADMIUM AND ALLOYS THEREOF

BACKGROUND OF THE INVENTION

1. Field of the Invention

This invention relates to the process for treating metal surfaces to become more corrosion resistant, and more particularly to an improved method for chromating a metal selected from the group consisting of zinc, cadmium and alloys thereof.

2. Description of the Prior Art

Surfaces of zinc, cadmium and alloys have become more corrosion resistant when treated in a solution containing chromium ions. Depending on the content of such solutions, blue, yellow, black or olive-colored surfaces are created which not only have marked differences in color, but also in corrosion resistance. Especially blue chromates yield light blue surfaces with good corrosion resistance.

A measure of corrosion resistance of such chromating solutions is a salt spray test according to ASTM B-117 protocol wherein a plated and passivated part is subjected to a 5% salt spray at 35° C. and 100% humidity. The time is measured to oxidize 5–10% of the surface to white rust. An alternative method has been developed by the EG&G Princeton Applied Research (Potentiostat/Galvanostat) may also be utilized in conjunction with software and an Apple II computer to measure corrosion resistance wherein the sample is immersed in an electrolyte and the current-potential-curve around the equilibrium potential is measured against a platinum electrode with the aid of a reference electrode. The resultant curves permit the calculation of the loss of metal in mpy (mils per year) with the smaller value being a better measure of corrosion resistance. The conducting electrode is comprised of 50 g/l NaCl, 10 ml/l phosphoric acid (85%) adjusted to pH 6.0 with NaOH. The second protocol has the advantage over the ASTM B-117 protocol in that corrosion resistance is provided in a short time, for example, about 15 minutes.

In U.S. Pat. No. 4,263,058/DE-OS 30 38 699 there is described an acidic, chrome-containing passivating solution comprising in addition to a "blue solution" of trivalent chromium ions, an acid, such as formic-, acetic-, propionic-acid or nitric-, sulfuric-, hydrochloric-, and hydrofluoric-acid. Also present are fluorides which form a "green solution" from hexavalent chromium ions, for instance, chrome-trioxide, alkali-metal-chromate of di-chromate and a reducing agent, such as an aldehyde or alcohol or an alkali-metal-sulfite, -bisulfite, -metabisulfite, -iodide, hydrogen peroxide, sulfur dioxide or an iron-II-salt-II-salt.

The presence of the poisonous hexavalent chromium compounds in the chromating solution permits the buildup of the hexavalent chromium into the surface of the passivating film, which can lead to dermatological illness if such films are used in the food processing industry. Handling of such solutions in the plant as well as waste treatment of used solution or rinse water can cause problems. Additionally, such solutions are rapidly consumed and can be regenerated only on a limited scale with concomitant high costs for continuous waste treatment and new make-up.

For several years, attempts have been made to produce blue chromates by using the tervalent chromium ion in the absence of the hexavalent chromium ion. Acidic solutions of such materials can also contain additional oxidizing agents (U.S. Pat. No. 4,171,231). Other additives such as silicates and/or metallic ions (U.S. Pat. No. 4,384,902, 4,389,247 and 4,367,099 ) or organo phosphorus compounds (U.S. Pat. No. 4,539,348) or carbonic acid (U.S. Pat. 4,349,392) disclose other additives. Such disclosed processes produce decorative blue- or yellow-chromated surfaces which cannot be subsequently dyed, with corrosion protection values reaching 6 hr. to 10% white rust according to the ASTM B-117 protocol. The presence of such oxidizing agent cannot assure the absence of hexavalent chrome compounds in the thus produced coatings. Still further, the waste water treatment is much more difficult in the presence of an oxidizing agent as a result of a rise in pH values in the sedimentation tank.

In German Patent 38 12 076, there is disclosed a process for using tervalent chrome compounds in fixed amounts together with soluble nitrates, fluoride and hydrochloric or nitric acid when the mixture is either heated to 60° C. or treated with a catalyst, like activated carbon, above 15° C. during which there is formed the green chrome-fluoride-complex of the general formula;

$$[Cr(H_2O)_6-xF_x]^{(3-x)+} \text{ with } 0<x=<3$$

Such a passivating solution is very sensitive to iron contamination since such acidic chromating solution dissolves small amounts of iron from plated steel parts, especially from such parts which, because of their geometrical shape, are not totally covered with zinc. Additionally, such protocol requires constant pH control since the process can be only operated successfully over a narrow pH range of from 1.6–2.0. The existence of fluoride, however, destroys the electrodes making it impossible to automatically control the pH. Additionally, the removal of fluoride from the effluent is difficult with high concentrations of make-up required with concomitant high costs as well as high drag-out losses.

OBJECTS OF THE INVENTION

It is an object of the present invention to provide an improved tervalent chromium based chromating solution for chromating zinc, cadmium and their alloys.

Still another object of the present invention is to provide an improved process for chromating zinc, cadmium and their alloys.

SUMMARY OF THE INVENTION

These and other objects of the present invention are achieved by forming a chromating solution from a trivalent chromium based-oxalic complex of the following general formula:

$$[Cr(C_2O_4)_x(H_2O)_{6-2x}]_n^{+(3-2x)} \cdot A_{3-2x}^{-n}$$

wherein $0<x=<1.5$, A is selected from the group consisting of $Cl^-$, $Br^-$, $I^-$, $NO_3^-$, $SO_4^{2-}$, $PO_4^{31}$ and n is the value of the anion A;

or $$[Cr(C_2O_4)_x(H_2O)_{6-2x}]_m^{+(3-2x)} \cdot K_{3-2x}^{+m}$$

wherein $1.5<x=<3.0$, K is a cation selected from the group consisting of $H^+$, $Li^+$, $Na^+$, $K^+$ and $NH_4^+$ and m is the value of the cation K, and immersing metal parts into such a chromating solution.

DETAILED DESCRIPTION OF THE PRESENT INVENTION

The process of the present invention includes the preparation of solutions containing a soluble trivalent chromium oxalate complex of the general formula;

$$[Cr(CO_2O_4)_x(H_2O)_{6-2x}]_n^{+(3-2x)} \cdot A_{3-2x}^{-n}$$

wherein $0<x=<1.5$, A is an anion selected from the group consisting of $Cl^-$, $Br^-$, $I^-$, $NO_3^-$, $SO_4^{-2}$, and $PO_4^{-3}$ and n is the value of the anion A; or $$[Cr(CO_2O_4)_x(H_2O_4)_{6-2x}]_m^{+(3-2x)} \cdot K_{3-2x}^{+m}$$

wherein $1.5<=<3.0$, K is a cation selected from the group consisting of $H^+$, $Li^+$, $N_a^+$, $K^+$ and $NH_4^+$ and m is the value of the cation K.

A preferred embodiment of the present invention is the resulting chromating solution of the anionic or A form wherein x is from 0.25 to 0.5, preferably 0.5 resulting in a chromium oxalate complexing as follows:

$$[Cr(C_2O_4)_{0.5}(H_2O)_5]_n^{+2} \cdot A_2^{-n}$$

After formulation of the solutions, the complex solutions are either heated to a boil to cause the violet color of the complex solution to change to red-violet or alternately the complex solutions are permitted to stand for a time sufficient to effect such color change. After cooling to room temperature or after color change, sufficient distilled water is added to make 1 liter of a chromating solution having of from about 0.1 to 50.0 g. of said chromium oxalate complex.

EXAMPLES OF THE INVENTION

The process of the present invention is set forth in the following specific examples which are intended to be merely illustrative and the present invention is intended not to be limited thereto.

EXAMPLE 1

Different chromating solutions containing tervalent chromium ions are formed by adding 180 ml (253.8 g) of a technical chrome nitrate solution (65%) to oxalic solutions as set forth in Table 1 below. Following admixture, the mixture is heated to boiling whereupon the violet color of the solution is changed to red-violet whereupon after cooling to room temperature, distilled water is added to form 1 L.

TABLE 1

| Ratio Oxalic Acid/Chrom mol/mol (equals x) | Oxalic Acid mol/l | Oxalic Acid g/l |
|---|---|---|
| 0 | 0 | 0 |
| 0.25 | 0.10 | 12.9 |
| 0.5 | 0.21 | 25.8 |
| 0.75 | 0.31 | 38.7 |
| 1 | 0.41 | 51.7 |
| 1.5 | 0.62 | 77.5 |
| 2 | 0.82 | 103.3 |
| 3 | 1.23 | 155.0 |

EXAMPLE 2

40 ml of the respective concentrates of Example 1 are added to one liter of water and pH adjusted. Zinc plated panels are dipped into such solutions for 30 or 60 seconds, rinsed and dried with compressed air with the resulting panels optically inspected and measured for corrosion resistance as set forth in Table 2 below using a Princeton Applied Research Potentiostat/Galvanostat:

TABLE 2

| Oxalate: Chrome Mol/Mol | Corrosion RAte MPY pH-value 1.4 | 1.6 | 1.9 | 2.5 |
|---|---|---|---|---|
| 0.00 | 13.08/15.33 | 15.20/15.10 | 22.12/21.01 | --.--/--.-- |
| 0.25 | 10.75/8.79 | 11.16/9.44 | 14.06/13.93 | --.--/--.-- |
| 0.50 | 3.66/1.92 | 4.91/4.79 | 5.41/2.87 | --.--/--.-- |
| 0.75 | 23.55/13.08 | 19.09/16.53 | 8.36/6.95 | --.--/--.-- |
| 1.00 | 61.21/43.33 | 24.75/15.17 | 9.82/4.17 | --.--/--.-- |
| 1.50 | --.--/--.-- | 26.22/11.93 | 12.68/4.41 | 47.44/10.57 |
| 2.00 | --.--/--.-- | 60/92.57 | 21.82/3.46 | 21.33/9.39 |
| 3.00 | --.--/--.-- | --.--/198 | 222/40.14 | 255/41.21 |

EXAMPLE 3

The corrosion resistance of the chromating solutions of Example 2 above is tested by the Princeton Applied Research method (Table 2) as well as the ASTM B-117 as set forth in Table 3.

TABLE 3

| Oxalate-Chrome Mol/Mol | pH-Value Bath | Hours Salt Spray 4 | 22 | 66 |
|---|---|---|---|---|
| 0.5 | 1.7 | | 40 | 85 |
| 0,5 temp. | 1.7 | | 5 | 35 |
| 0.5 | 2.0 | | 5 | 30 |
| 0.5 temp. | 2.0 | | <1 | 5 |
| 1.0 | 1.7 | | 100 | |
| 1.0 temp. | 1.7 | | 100 | |
| 1.0 | 2.0 | | 25 | 70 |
| 1.0 temp. | 2.0 | | 15 | 35 |
| 1.5 | 1.7 | 100 | | |
| 1.5 temp. | 1.7 | 100 | | |
| 1.5 | 2.0 | | 50 | 100 |
| 1.5 temp. | 2.0 | | 10 | 25 |

Surprising, it is found that the corrosion resistance is increased with parts which are tempered prior to testing, a fact which had not been the case with any known chromates.

EXAMPLE 4

4 g. of chrome compound A and oxalate compound B are dissolved in one liter of water heated to boiling and allowed to cool down to room temperature. Predetermined C ml of the concentrate is diluted with water to one liter and pH adjusted to the values as set forth in Table 4 below.

TABLE 4

| A in g (mol) | B in g (mol) | C in ml | D (pH) |
|---|---|---|---|
| $Cr(NO_3)_3*9H_2O$ 77 (0.192) | $H_2C_2O_4*2H_2O$ 12(0.095) | 40 | 1.6 |
| $Cr(NO_3)_3*9H_2O$ 308 (0.770) | $H_2C_2O_4*2H_2O$ 48 (0.381) | 40 | 1.9 |
| $CrCl_3*6H_2O$ 150 (0.563) | $Na_2C_2O_4$ 75 (0.560) | 20 | 2.2 |
| $KCr(SO_4)_2*12H_2O$ 350 (0.701) | $NH4C_2O_4*H_2O$ 25 (0.716) | 10 | 1.7 |
| $CrCl_3*6H_2O$ 75 (0.281) | $K_2C_2O_4H_2O$ 104 (0.564) | 100 | 2.5 |

The solutions made in accordance with this example produced a blue passivation film with good corrosion resistance.

While the invention has been described in connection with any exemplary embodiments thereof, it will be understood that many modifications will be apparent to those of ordinary skill in the art and that this application is intended to cover any adaptations or variations thereof. Therefore, it is manifestly intended that this invention be only limited by the claims and the equivalents thereof.

What is claimed is:

1. An improved process for chromating a metal which comprises:

immersing an article formed of a metal selected from the group consisting of zinc, cadmium and alloys thereof in a water solution of a soluble chromic oxalate complex at a pH of from 1.2 to 3.0, said soluble chromic oxalate complex being selected from the group consisting of:

$$[Cr(C_2O_4)_x(H_2O)_{6-2x}]_n^{+(3-2x)} \cdot A_{3-2x}^{-n}$$

wherein $0<x=<1.5$, A is an anion selected from the group consisting of $Cl^-$, $Br^-$, $I^-$, $NO_3$ , $SO_4^{-2}$ and $PO_4^{-3}$ and n is the value of the anion of A, and $$[Cr(C_2O_4)_x(H_2O)_{6-2x}]_m^{+(3-2x)} \cdot K_{3-2x}^{+m}$$

wherein $1.5>x=>3.0$, K is a cation selected from the group consisting of $H^+$, $Li^+$, $Na^+$, $K^+$ and $NH_4^+$ and m is the value of the cation K.

2. The improved process for chromating a metal as defined in claim 1 wherein molar ratio of oxalate to tervalent chrome is from 0.1 to 3.0.

3. The improved process for chromating a metal as defined in claim 1 wherein said soluble chromium oxalate complex is present in an amount of from 0.1 to 50 g. per liter of solution.

4. The improved process for chromating a metal as defined in claim 2 wherein said soluble chromium oxalate complex is present in an amount of from 0.1 to 50 g. per liter of solution.

5. The improved process for chromating a metal as defined in claim 2 wherein said molar ratio is preferably 1.0 to 2.0.

6. A chromating solution which comprises a water solution of a soluble chromium oxalate complex having a pH of from 1.2 to 3.0, said soluble chromium oxalate complex being selected from the group consisting of:

$$[Cr(C_2O_4)_x(H_2O)_{6-2x}]_n^{+(3-2x)} \cdot A_{3-2x}^{-n}$$

wherein $0<x=<1.5$, A is an anion selected from the group consisting of $Cl^-$, $Br^-$, $I^-$, $NO_3^-$, $SO_4^{-2}$ and $PO_4^{-3}$ and n is the value of the anion A, and $$[Cr(C_2O_4)_x(H_2O)_{6-2x}]_n$$

wherein $1.5<x=<3.0$, K is a cation selected from the group consisting of $H^+$, $Li^+$, $Na^+$, $K^+$ and $NH_4$ and m is the value of the cation K.

7. The chromating solution as defined in claim 6 wherein said soluble chromium oxalate complex is selected from the group consisting of:

$$[Cr(C_2O_4)_x(H_2O)_{6-2x}]_n^{+(3-2x)} \cdot A_{3-2x}^{-n}$$

wherein $0<x=<1.5$, A is an anion selected from the group consisting of $Cl^-$, $Br^-$, $I^-$, $NO_3^-$, $SO_4^{-2}$ and $PO_4^{-3}$ and n is the value of the anion A, and $$[Cr(C_2O_4)_x(H_2O)_{6-2x}]_m^{+(3-2x)} \cdot K_{3-2x}^{-m}$$

wherein $1.5<x=<3.0$, K is a cation selected from the group consisting of $H^+$, $Li^+$, $Na^+$, $K^+$ and $NH_4^{+4}$ and m is the value of the cation K.

8. The chromating solution as defined in claim 6 wherein wherein molar ratio of oxalate to tervalent chrome is from 0.1 to 3.0.

9. The chromating solution as defined in claim 7 wherein wherein molar ratio of oxalate to tervalent chrome is from 0.1 to 3.0.

10. The chromating solution as defined in claim 8 wherein molar ratio of oxalate to tervalent chrome is from 0.1 to 3.0.

11. The chromating solution as defined in claim 6 wherein said soluble chromic oxalate complex is present in an amount of from 0.1 to 50 g. per liter of solution.

12. The chromating solution as defined in claim 8 wherein said soluble chromic oxalate complex is present in an amount of from 0.1 to 50 g. per liter of solution.

* * * * *